US006988903B1

(12) United States Patent
Cheng

(10) Patent No.: US 6,988,903 B1
(45) Date of Patent: Jan. 24, 2006

(54) EXTRACTABLE CONVERSION PLUG WITH A SAFETY PROTECTION MEANS

(75) Inventor: Jen-Jen Cheng, Taipei (TW)

(73) Assignee: Edac Power Electronics Co., Ltd., Taipei (TW)

( * ) Notice: Subject to any disclaimer, the term of this patent is extended or adjusted under 35 U.S.C. 154(b) by 0 days.

(21) Appl. No.: 11/094,143

(22) Filed: Mar. 31, 2005

(51) Int. Cl.
*H01R 13/44* (2006.01)

(52) U.S. Cl. ..... 439/137; 439/172; 439/929

(58) Field of Classification Search ..... 439/26, 439/137, 171–172, 374, 929
See application file for complete search history.

(56) References Cited

U.S. PATENT DOCUMENTS 5,634,806 A * 6/1997 Hahn ..... 439/173
5,702,259 A * 12/1997 Lee ..... 439/137
5,848,907 A * 12/1998 Chen ..... 439/172
6,123,557 A * 9/2000 Wang et al. ..... 439/137
6,893,275 B2 * 5/2005 Ng et al. ..... 439/137
6,923,666 B1 * 8/2005 Liao ..... 439/172

FOREIGN PATENT DOCUMENTS

JP 2004-31260 * 1/2004

* cited by examiner

*Primary Examiner*—Michael C. Zarroli

(57) ABSTRACT

An extractable conversion plug with a safety protection means includes a spring is located between a moveable pillar of a slab and a latching element, inside a connection head, such that the slab can cover conduction pieces through an elastic force from an expansion of the spring, thereby preventing the conduction pieces from being exposed. Upon emplacing the connection head at a base seat, the slab is stopped from moving by a stopper, and the conduction pieces are exposed and are contacted with spring leaves of the base seat, thereby constituting a close-circuit status. When the base seat falls off by accident, a stopping force of the slab is relieved to release a compression force from the spring, which will cause the spring to expand, so as to move the slab to cover the conduction pieces, thereby preventing from getting an electric shock by a careless touch.

3 Claims, 12 Drawing Sheets

EXTRACTABLE CONVERSION PLUG WITH A SAFETY PROTECTION MEANS

BACKGROUND OF THE INVENTION (a) Field of the Invention

The present invention relates to an extractable conversion plug with a safety protection means, and more particularly to an extractable conversion plug wherein a spring is installed between a moveable pillar of a slab and a latching element, inside a connection head, such that the slab can cover conduction pieces through an elastic force from an expansion of the spring, thereby preventing the conduction pieces from being exposed.

Upon emplacing the connection head at a base seat, gliding edges of the connection head are put into gliding slots. When the slab is stopped from keeping on moving by a stopper, the conduction pieces are exposed due to a persistent moving of the connection head, and are contacted with spring leaves of the base seat, thereby constituting a close-circuit status. In the mean time, the spring is under compression due to an offset of one end of the moveable pillar and latching element.

When the base seat falls off by accident, a stopping force of the slab is relieved to release a compression force from the spring, which will cause the spring to expand, so as to move the slab to cover the conduction pieces, thereby preventing a user from getting an electric shock by a careless touch.

(b) Description of the Prior Art

Referring to FIG. 1 and FIG. 2, a conventional extractable conversion plug A consists of a connection head A1 and a base seat A2. Upon using the plug, a raised edge A11 of the connection head A1 is put into a gliding slot A21 of the base plate A2, so as to enable conduction pieces A12 to be in contact with spring leaves A22, and a raised element A23 is latched into a groove A13.

Referring to FIG. 3, when a conventional extractable conversion plug A is fixed on an outlet B, a base seat A2 is easy to be loosened from a connection head A1 if a latching structure between the connection head A1 and the base seat A2 is loosened from being kicked out by a user accidentally or after a long time of usage, at which conduction pieces A12 are exposed outside and thus easy to cause the user to touch carelessly, and get an electric shock.

Accordingly, how to provide an extractable conversion plug with a safety protection means is a problem which needs to be solved by the inventor.

SUMMARY OF THE INVENTION

The primary object of the present invention is to provide an extractable conversion plug with a safety protection means. Referring to FIG. 4 and FIG. 5, a plug is constituted by a connection head, a spring, a slab, a latching element, and a base seat, wherein a latching groove, gliding slots, gliding edges, a holding groove, and a screw hole are installed on the connection head, moveable edges and a moveable pillar are installed on the slab, and a gliding slot, a stopper, and spring leaves are installed on the base seat. The moveable edges and the moveable pillar of the slab are inserted into the gliding slots and the holding groove of the connection head, respectively. The spring is then inserted into the holding groove of the connection head. After that, the latching element is put into the latching groove and fixed by passing a screw through screw holes.

Referring to FIG. 7, the spring is located between the moveable pillar and the latching element of the slab, and the slab can be covered on conduction pieces through an elastic force from an expansion of the spring, so as to prevent the conduction pieces from being exposed. Upon emplacing the connection head at the base seat, the gliding edges of the connection head are emplaced into the gliding slot. On the other hand, when the slab is stopped by the stopper and cannot keep on moving, the conduction pieces will be exposed due to a persistent moving of the connection head and will be contacted with the spring leaves of the base seat, thereby constituting a close-circuit condition. In the mean time, the spring is under compression due to an offset of one end of the moveable pillar and the latching element. Therefore, when the base seat falls off by accident, a stopping force of the slab will be relieved to release a compression force of the spring, which will cause the spring to expand, so as to move the slab to cover the conduction pieces, thereby preventing a user from getting an electric shock by a careless touch.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
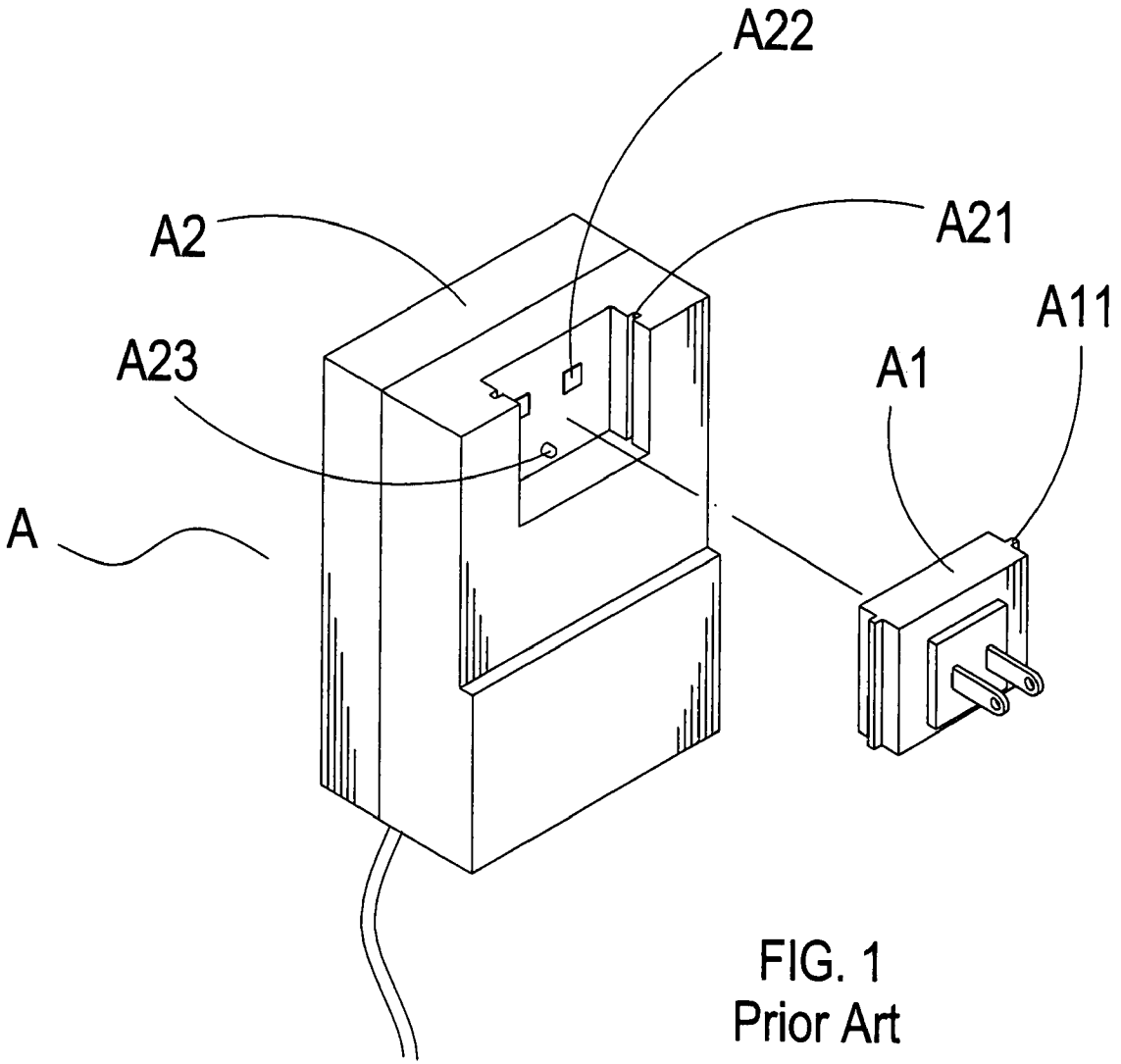
FIG. 1 Prior Art
FIG. 1 shows a perspective view of a conventional extractable conversion plug.
Figure 2:
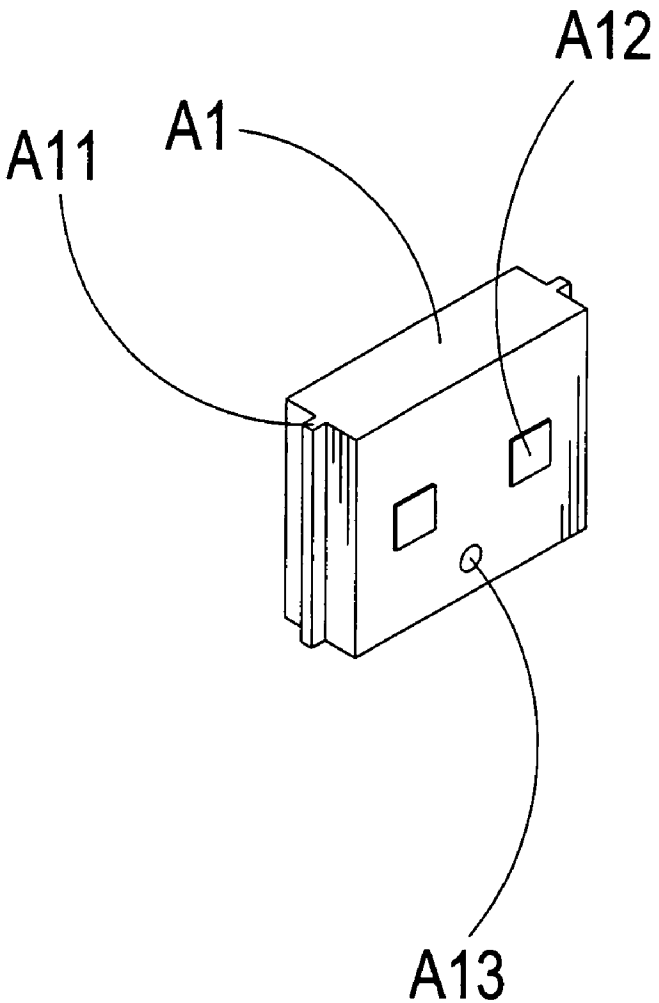
FIG. 2 Prior Art
FIG. 2 shows a rear view of a conventional connection head.
Figure 3:
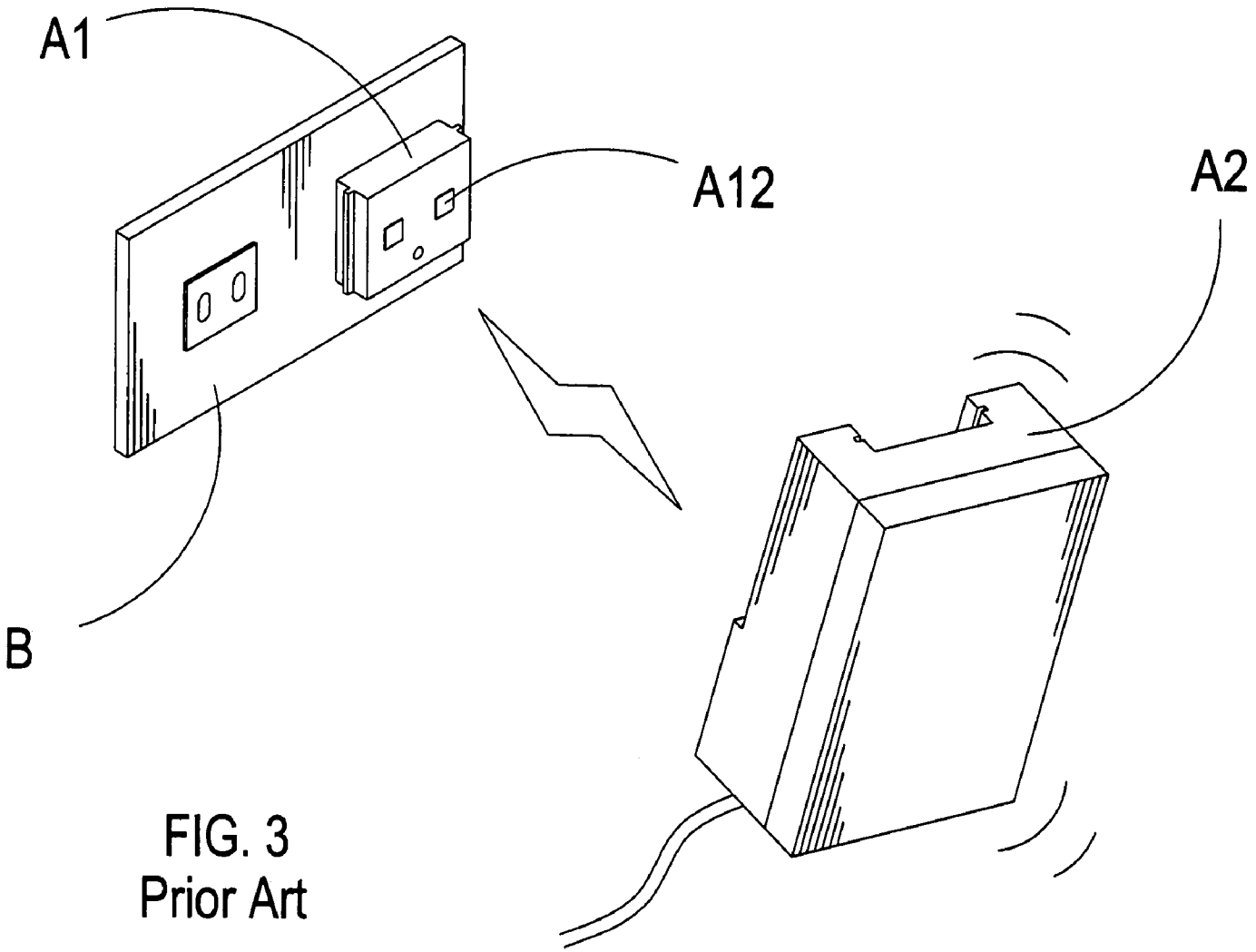
FIG. 3 Prior Art
FIG. 3 shows a perspective view of a fall-off condition of a conventional extractable conversion plug.
Figure 4:
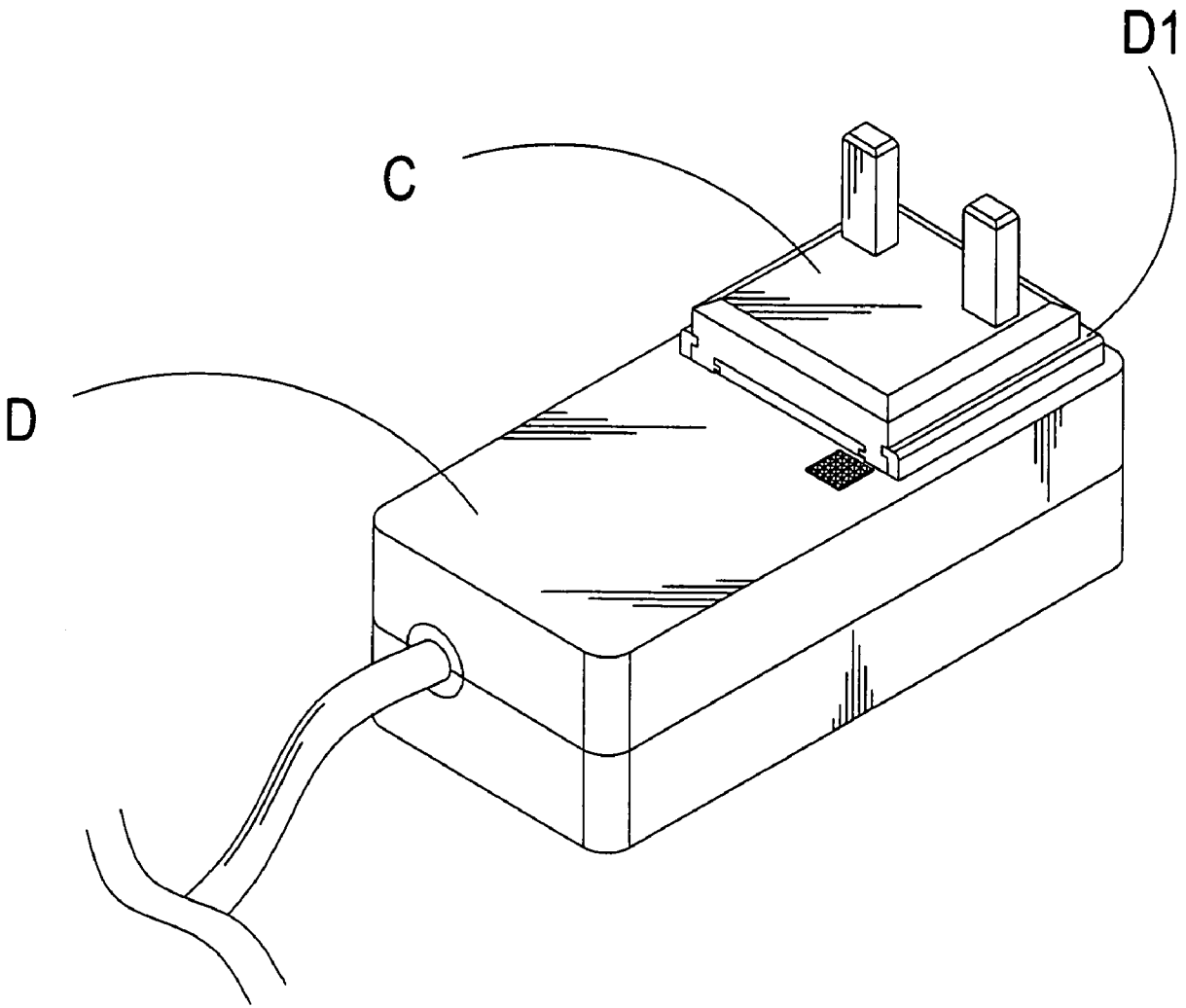
FIG. 4 shows a perspective view of the present invention.
Figure 5:
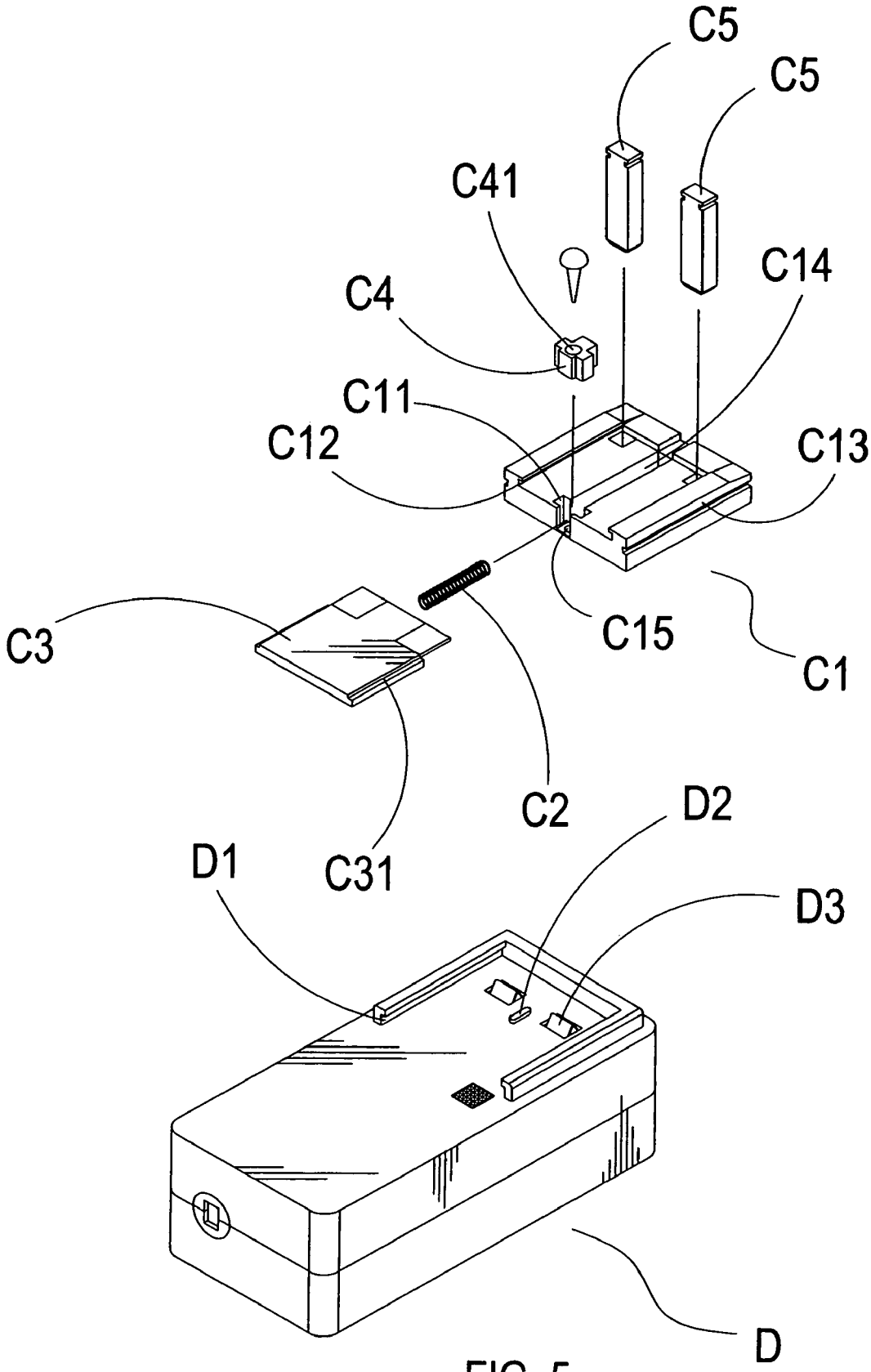
FIG. 5 shows an assembly view of the present invention.
Figure 6:
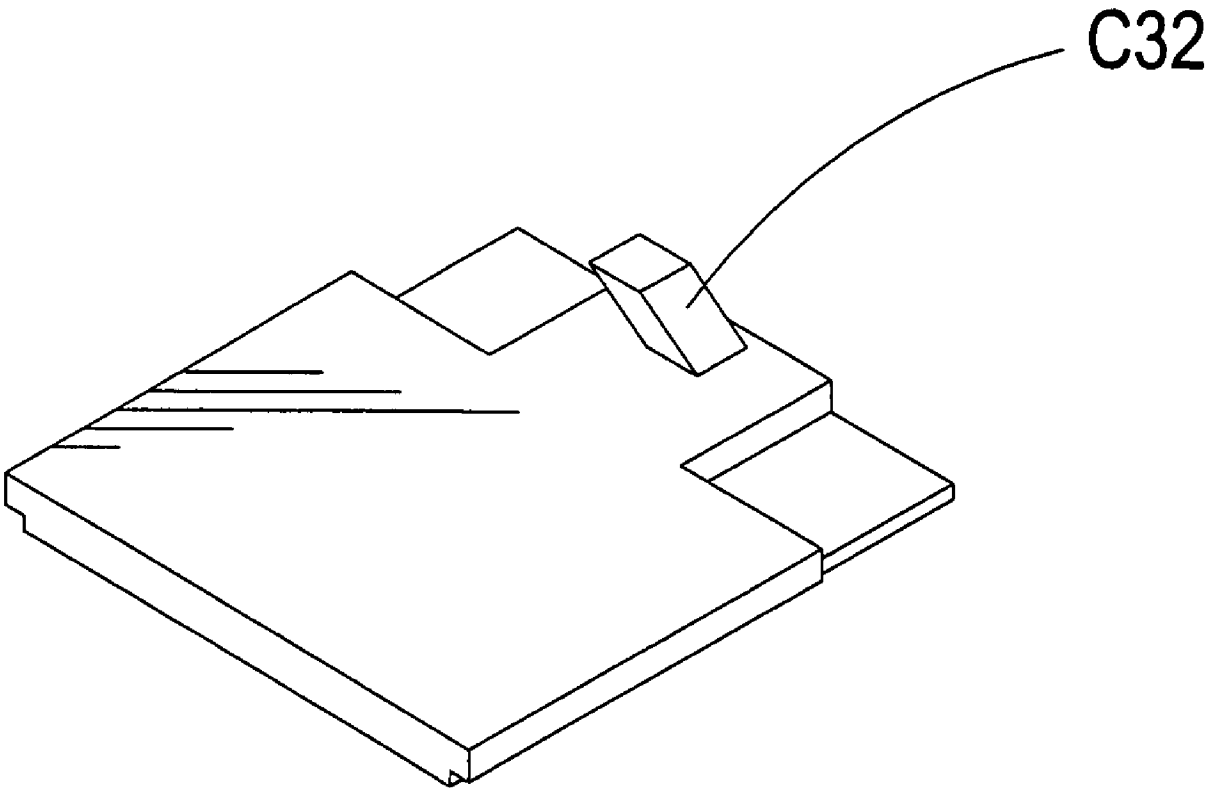
FIG. 6 shows a schematic view of another side of a slab of the present invention.
Figure 7:
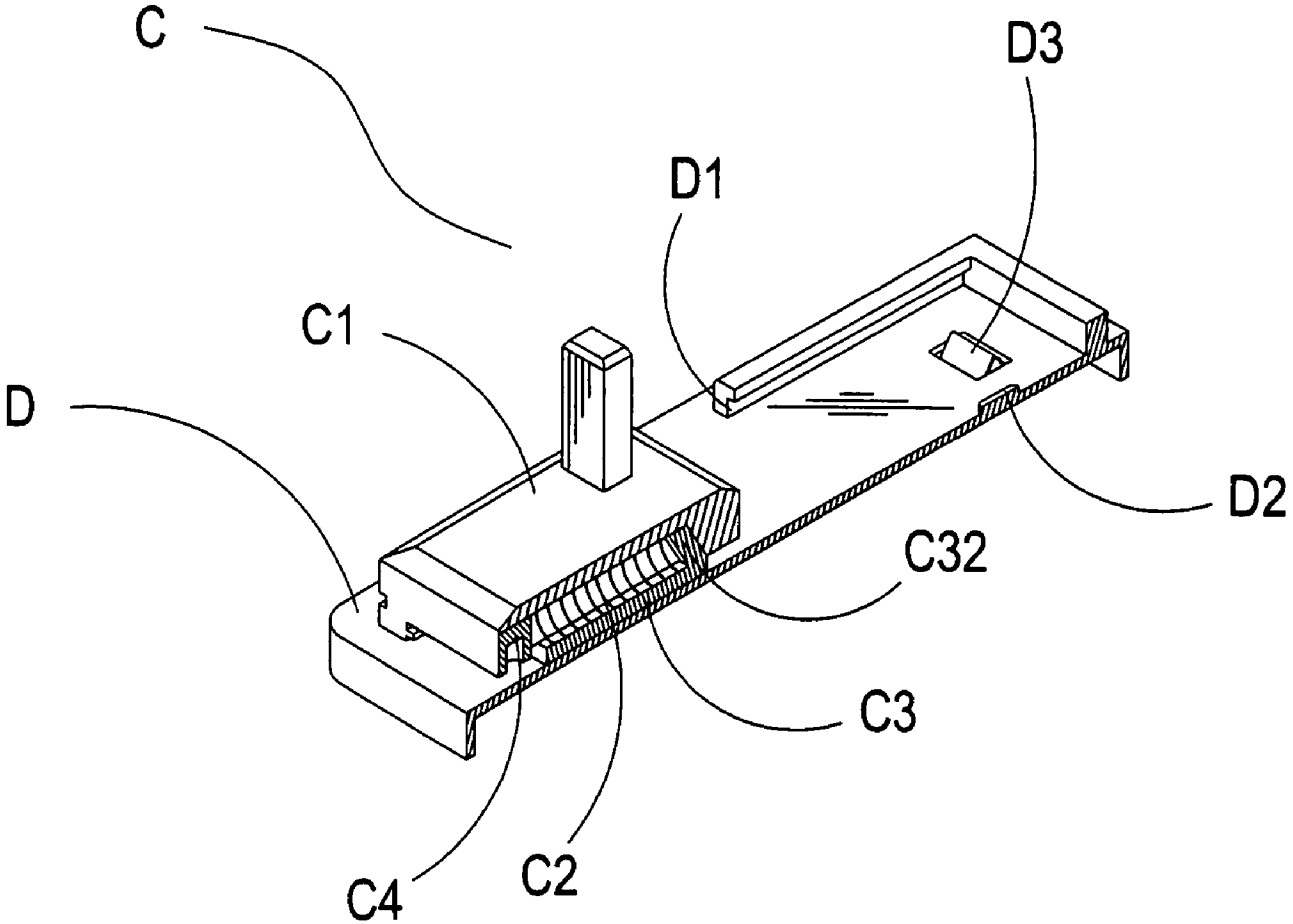
FIG. 7 shows a cutaway view of the present invention.
Figure 8:
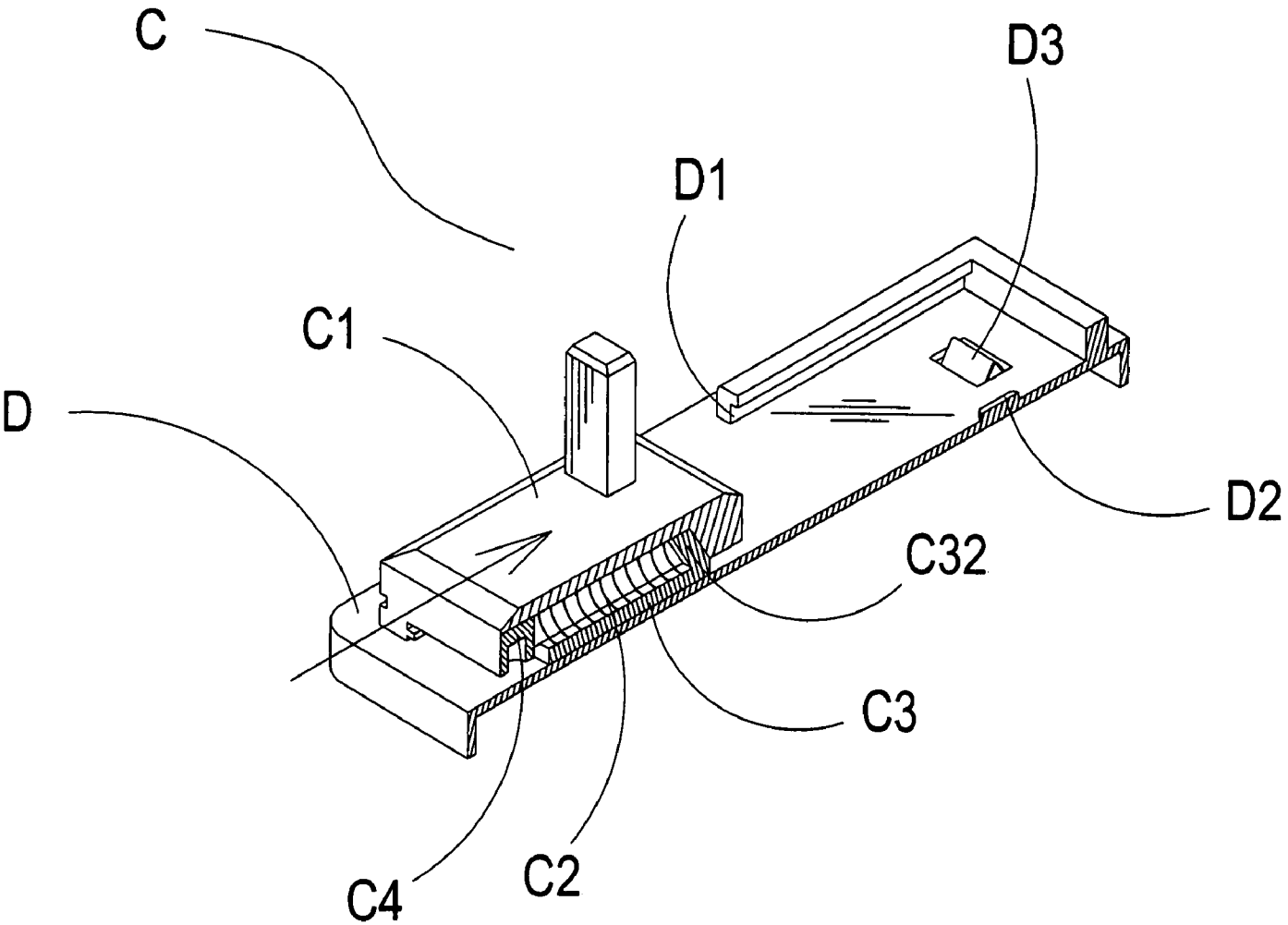
FIG. 8 shows a cutaway view of an action of the present invention.

Referring to FIG. 8, it shows an implementation of the present invention. Before emplacing a connection head C1 at a base seat D, a spring C2 is located between a moveable pillar C32 and a latching element C4 of a slab C3, so as to cover the slab C3 on conduction pieces C5 through an elastic force of the spring C2, thereby preventing the conduction pieces C5 from being exposed.

Figure 9:
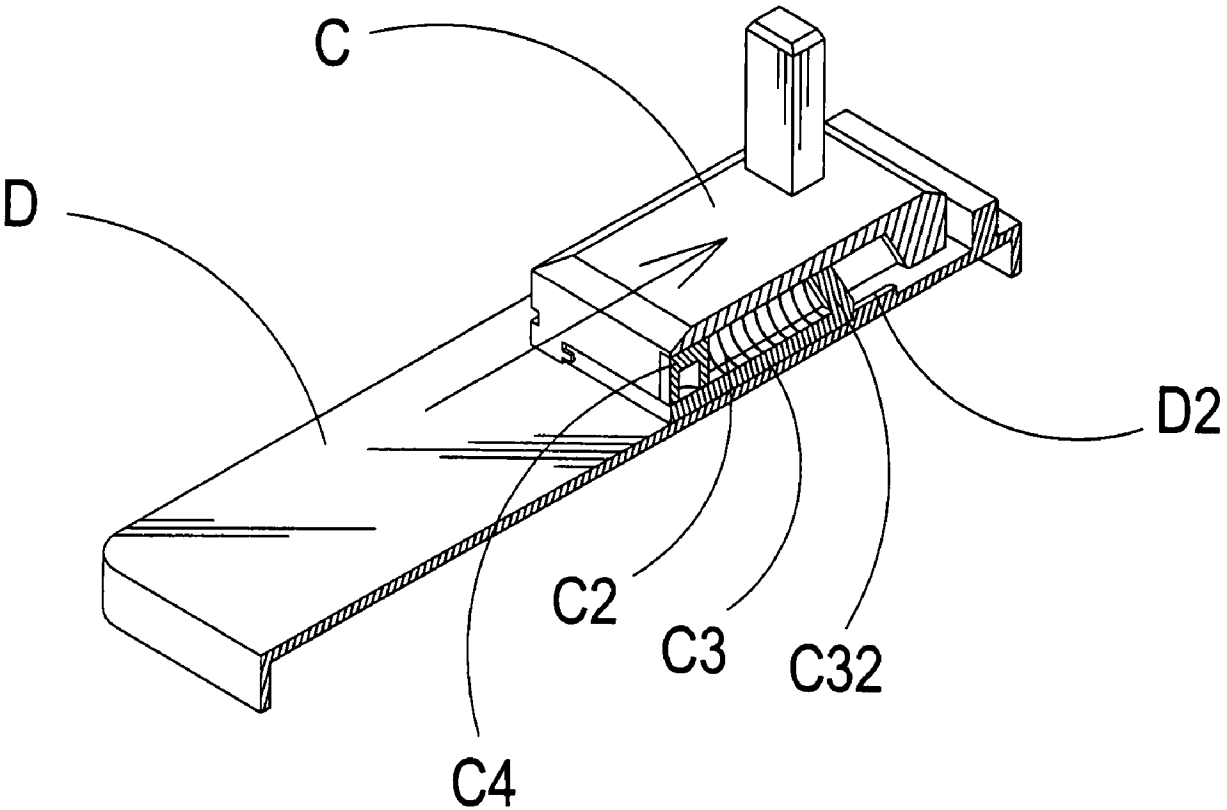
FIG. 9 shows a second cutaway view of an action of the present invention.
Figure 10:
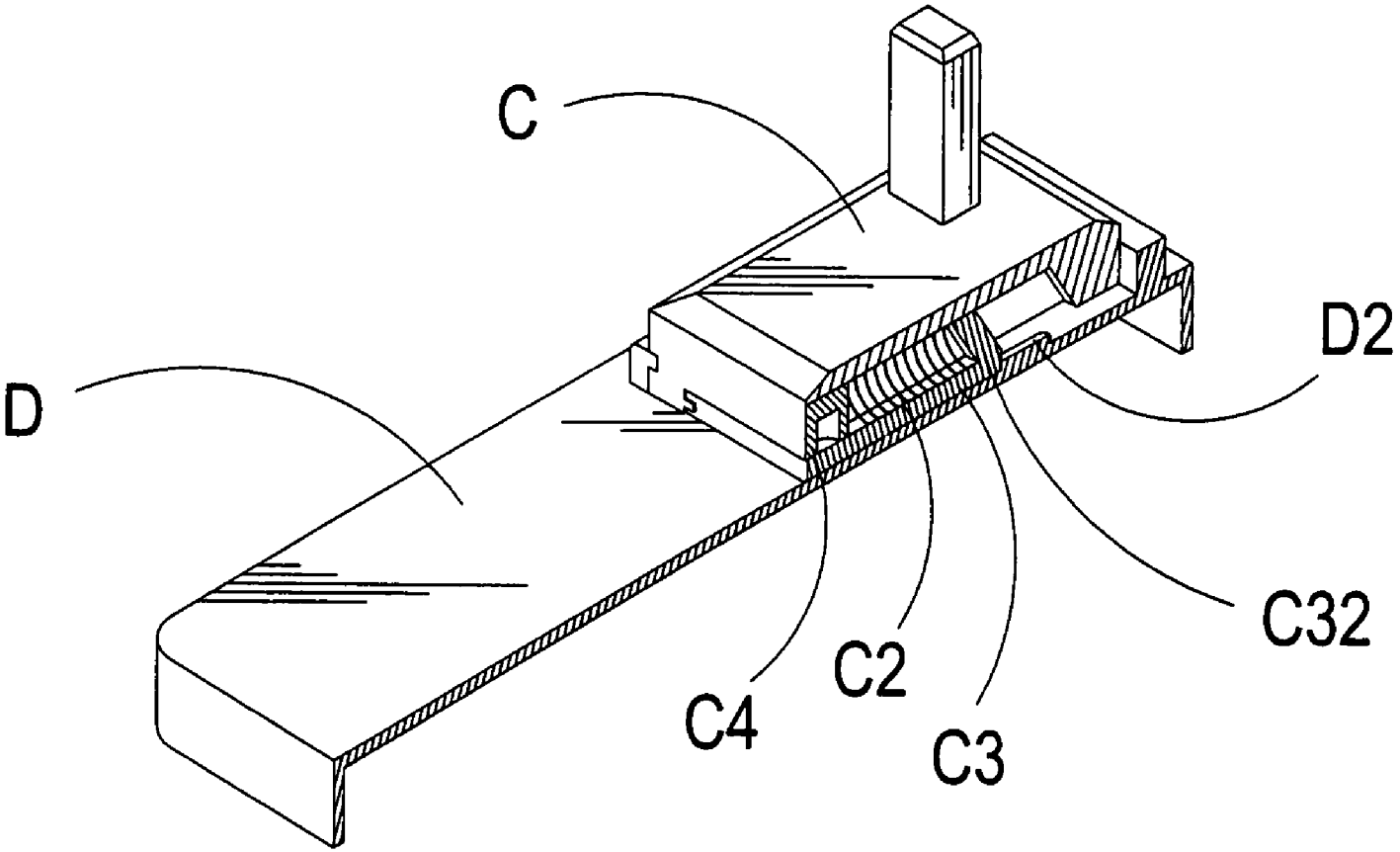
FIG. 10 shows third cutaway view of an action of the present invention.

Referring to FIG. 9 and FIG. 10, upon emplacing the connection head C1 at the base seat D, gliding edges C13 is moving inside a gliding slot D1, and the slab C3 is gradually approaching to a stopper D2 of the base seat D. When the connection head C1 keeps on moving, the stopper D2 will stop the slab C3 from moving further. At this time, the moveable pillar C32 will be immoveable due to a stop of the slab C3, but the spring C2 will start to be compressed due to a persistent moving of the latching element C4 at the other end of spring C2.

When the connection head C1 keeps on moving until completely inserting the gliding edges C13 into the gliding slot D1, the conduction pieces C5 will be exposed and contacted with spring leaves D3 to constitute a close-circuit condition due to a persistent stop of the slab C3. At this time, a plug C can be connected to a socket for conducting electricity, and the spring C2 is compressed to its maximum extent.

Figure 11A:
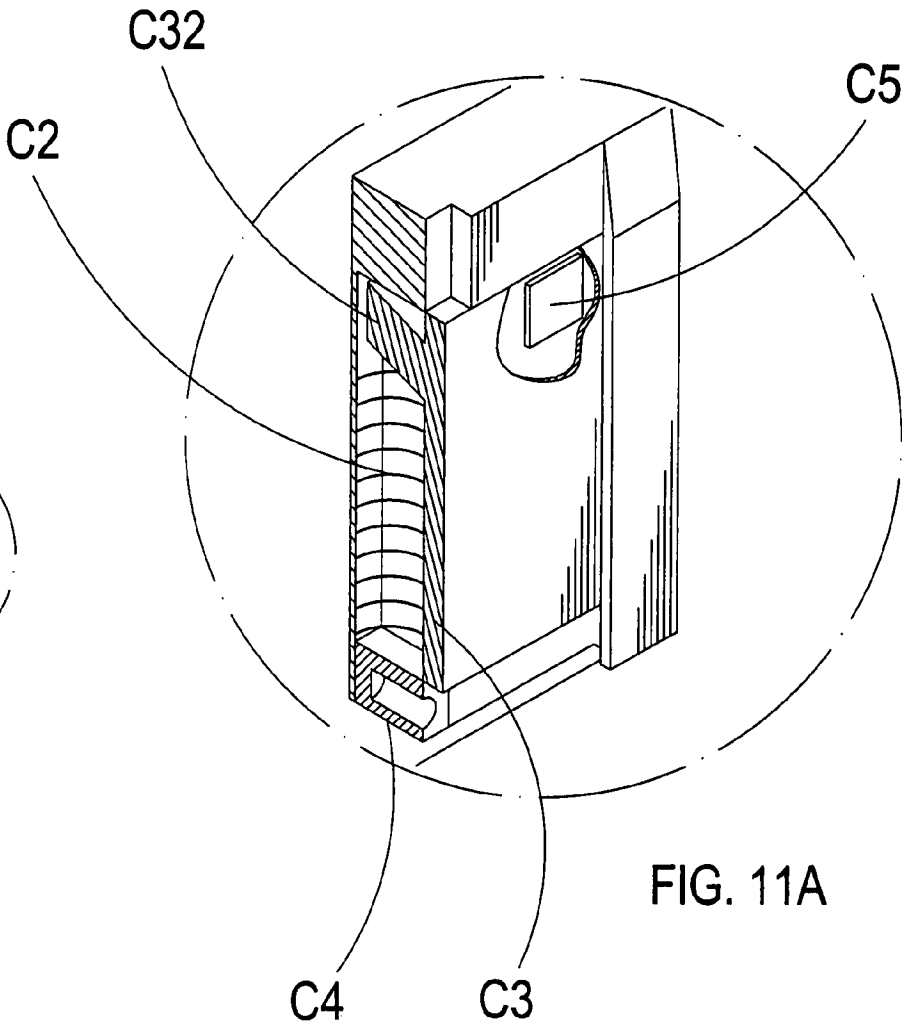
FIG. 11A shows a blowup view of part a of FIG. 11.
Figure 11:
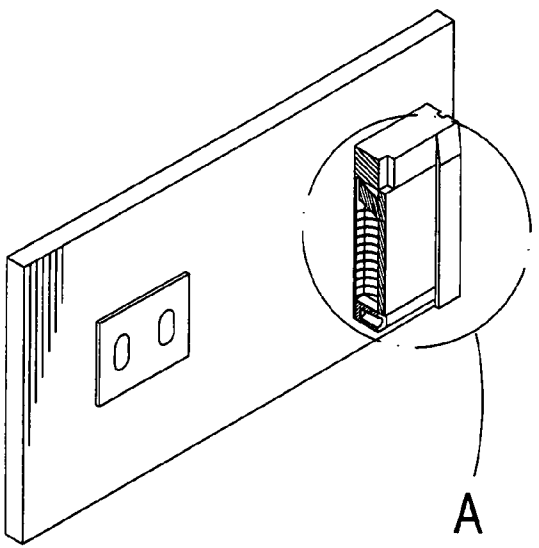
FIG. 11 shows a fourth cutaway view of an action of the present invention.

Referring to FIG. 11 and FIG. 11A, when the base seat D falls off by accident, the slab C3 can be in a mobilized state due to that the stopper D2 of the base seat D is not stopping the slab C3. Moreover, as the spring C2 is turned into an expansion state from the aforementioned compression state, which completely relieves its elastic force, so as to put the moveable pillar C32 of the slab C3 against a top end of holding groove C14 of the connection head C1, and to move the slab C3 to cover on the conduction pieces C5 which are exposed previously, thereby preventing a user from getting an electric shock by a careless touch.

In addition, when a user wants to remove the connection head C1 from the socket B, he would not be worried about touching the conduction pieces C5 to get an electric shock during removing, as the connection head C1 is made of insulation material. Furthermore, if the base seat D falls off by accident, the user can directly mount the base seat D on the connection head C1 inserted on the plug C, before taking out the plug C.

Figure 12:
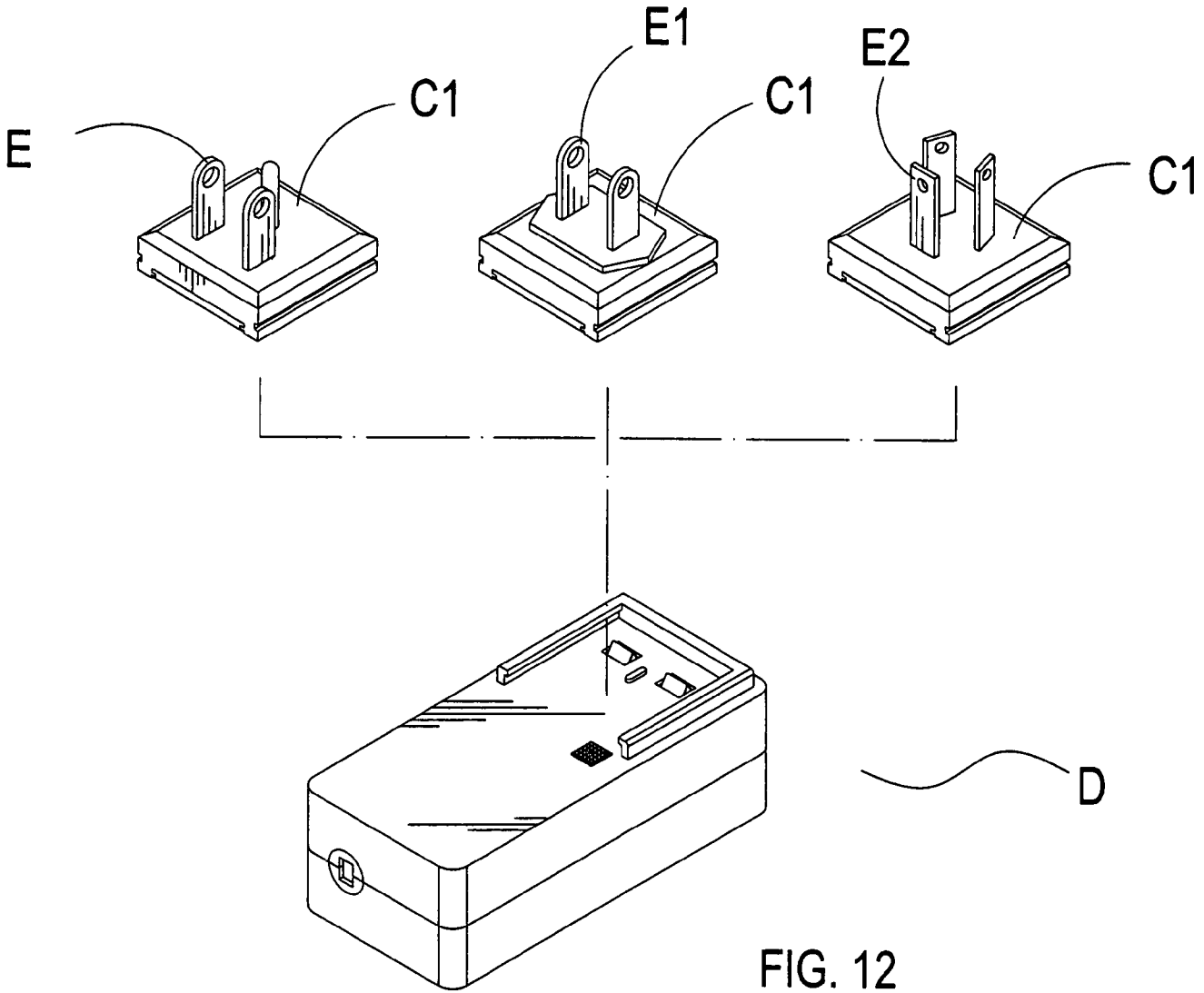
FIG. 12 shows a schematic view of a further implementation of the present invention.

Referring to FIG. 12, a connection head of the present invention can be further mounted with conduction pieces E, E1, and E2 of various sizes, quantities, and layouts, corresponding to specifications of power plugs in different countries. On the other hand, when the connection head C1 is not connected to the base seat D, the slab C3 can completely cover the conduction pieces E, E1, and E2.

To further manifest the advancement and practicability of the present invention, the present invention is compared with a conventional application as follow:

Shortcomings of a Conventional Application

There is no safety shielding for conduction pieces on a connection head.

If a base seat is loosened from the connection head by accident, the conduction pieces will be completely exposed, which will be easy to cause a user to get an electric shock.

Advantages of the Present Invention

Conduction pieces can be completely covered by a slab while not in use.

If a slab is loosened from a base seat by accident, the conduction pieces will be covered by the slab.

Accordingly, if the base seat falls off by accident upon connecting to a socket, the conduction pieces will be completely covered by the slab.

It can prevent a user from getting an electric shock.

It is provided with an advancement, practicability, and safety.

It can promote an industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An extractable conversion plug with a safety protection means comprising a connection head, a spring, a slab, a latching element, and a base seat, wherein the connection head is provided with a latching groove, gliding slots, gliding edges, a holding groove, and screw holes, the slab is provided with moveable edges and a moveable pillar, and the base seat is provided with a gliding slot, a stopper, and spring leaves; the moveable edges and moveable pillar of the slab being inserted into the gliding slots and holding groove of the slab respectively, next the spring being inserted into the holding groove of the connection head, then the latching element being inserted into the latching groove and fixed by a screw; the spring being located between the moveable pillar and the latching element of the slab, enabling the slab to completely cover conduction pieces through an elastic force from an expansion of the spring.

2. The extractable conversion plug with a safety protection means according to claim 1, wherein a stopper of the base seat is used to stop the slab from keeping on moving, such that the conduction pieces are exposed and contacted with spring leaves of the base seat for constituting a close-circuit condition.

3. The extractable conversion plug with a safety protection means according to claim 1, wherein the conduction pieces of the connection head can further be in various shapes, quantities, and layouts, corresponding to specifications of electricity in different countries.

* * * * *